United States Patent [19]

Cohen

[11] 4,368,995

[45] Jan. 18, 1983

[54] RING MECHANISM FOR LOOSE-LEAF BINDERS

[76] Inventor: Lewis Cohen, 205 The Bridle Path, Don Mills, Ontario, Canada, M3C 2P6

[21] Appl. No.: 190,072

[22] Filed: Sep. 23, 1980

[51] Int. Cl.[3] ..... B42F 13/20

[52] U.S. Cl. ..... 402/39

[58] Field of Search ..... 402/26, 31, 39, 40, 402/41

[56] References Cited

U.S. PATENT DOCUMENTS

| | | | |
|---|---|---|---|
| 1,897,001 | 2/1933 | Dawson | 402/40 |
| 1,915,140 | 6/1933 | Watson | 402/39 |
| 1,932,874 | 10/1933 | Adams et al. | 402/40 |
| 2,377,179 | 5/1945 | Pitt | 402/39 |
| 3,263,687 | 8/1966 | Weichert | 402/39 |

*Primary Examiner*—Paul A. Bell
*Assistant Examiner*—John S. Brown
*Attorney, Agent, or Firm*—Laff, Whitesel, Conte & Saret

[57] ABSTRACT

A loose-leaf binder has a cover and a ring mechanism. The ring mechanism includes a resilient base plate with curled edges and at least one rib extending laterally and downwardly. The ring mechanism also includes a pair of blades beneath the base plate and between the curled edges, the combined width of the blades being slightly greater than the distance between the curled edges. Also, the blades each have at least one slot along their outside edge to engage the rib. At least one pair of ring members fixed to the blades extend above the base plate to meet in a releasable juncture.

5 Claims, 8 Drawing Figures

RING MECHANISM FOR LOOSE-LEAF BINDERS

BACKGROUND OF THE INVENTION

This invention relates to loose-leaf binders or notebooks and more particularly, to an improved ring mechanism for retaining paper within the notebook.

A popular type of paper used with loose-leaf binders contains holes located near one edge of the paper. The paper can be stacked neatly and securely by inserting ring posts through the holes of the paper. These rings are commonly found in binders which also include a cover consisting of two flap portions joined by a central backing. The cover is often constructed of vinyl-covered cardboard or plastic.

The ring mechanism in the binder extends along the length of the backing on the inside of the cover and is secured thereto. The ring mechanism usually includes a pair of rails or blades nested under a resilient cover plate and two or more pairs of cooperating ring elements fixed to the blades. The blades are generally in a side-by-side relationship and are under tension because the combined width of the blades is slightly greater than the width of the plate. As a result, the ring members can be locked in either an open or shut position by applying stress to the ring members and forcing the blades to buckle either concavely or convexly beneath the cover plate.

Representative examples of prior ring assemblies showing one or more of these features are: U.S. Pat. No. 1,634,125; U.S. Pat. No. 1,815,511; U.S. Pat. No. 2,006,795; U.S. Pat. No. 2,504,355; French Pat. No. 1,201,593; German Pat. No. 687,769; and Swedish Pat. No. 181,288.

It is essential to the effective operation of the binder that the ring elements, each of which is independently affixed to a blade, always meet exactly at a juncture above the plate. Otherwise, paper can slip between the ring elements and out of the binder. The most common way for the ring elements to become disjointed is for the two blades to slide longitudinally with respect to each other. This may occur during normal use when substantial force is needed to close and separate the ring elements, or when the entire binder is dropped or undergoes unusual stress.

Some currently used ring mechanisms are constructed to reduce the possibility of the ring elements becoming disjointed by inserting the ring elements through coves or holes in the plate. These coves or holes limit the lateral movement of ring elements, but, because the coves or holes are necessarily larger than the diameter or thickness of the ring elements, there is still some leeway for the ring elements to move laterally. Often, even this slight leeway is sufficient to allow the ring elements to become disjointed after use because one or both of the blades have slid longitudinally to the extent permitted by the coves or holes. Reducing the size of the coves or holes increases the chances that the ring elements will not extend through the plate with sufficient space for smooth operation or, given the normal imprecision in machining that occurs, that the ring elements will even fit through the plate.

Accordingly, an object of the invention is to provide a new and improved ring mechanism which resists longitudinal displacement of the blades and insures a proper connection and meeting of the ring elements. A further object is to produce a stronger and more reliable base plate for the ring mechanism. Yet another object is to provide a more secure loose-leaf binder which is not easily damaged or disabled by shocks to the ring mechanism.

SUMMARY OF THE INVENTION

In keeping with one aspect of this invention, an apparatus is provided with a resilient base plate or shield having at least one protruding portion or depression extending underneath its surface. A pair of blades sit side-by-side beneath the base plate and between curled edges of the base plate. The combined width of the blades exceeds the distance between the curled edges of the base plate, thereby applying stress to the base plate and the blades. The blades each include at least one slot along their periphery with the curled edges for engaging the protruding portion. The apparatus also has at least one pair of ring elements, each of which is fixed to a different blade, extending up, or descending and then rising, from the blades to a point above the base plate to meet in a releasable juncture.

The above mentioned and other features of this invention and the manner of obtaining them will become more apparent, and the invention itself will be best understood by reference to the following description of an embodiment of the invention taken in conjunction with the accompanying drawings.

DETAILED DESCRIPTION OF THE INVENTION

Figure 1:
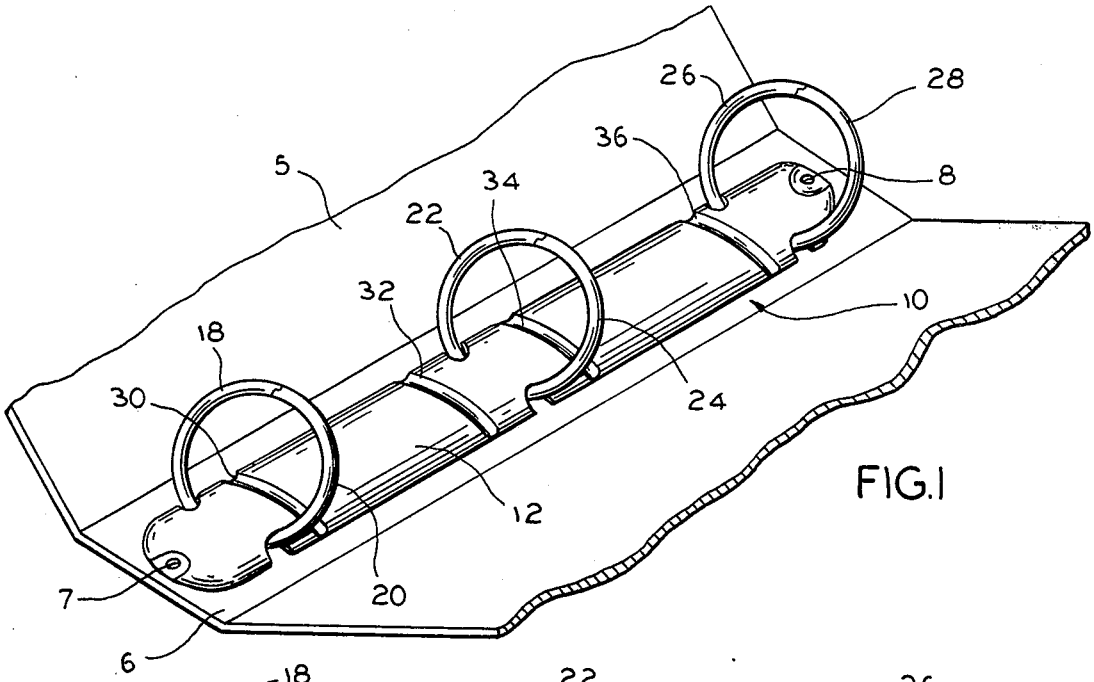
FIG. 1 is a top perspective view of the invention within a cover.
Figure 2:
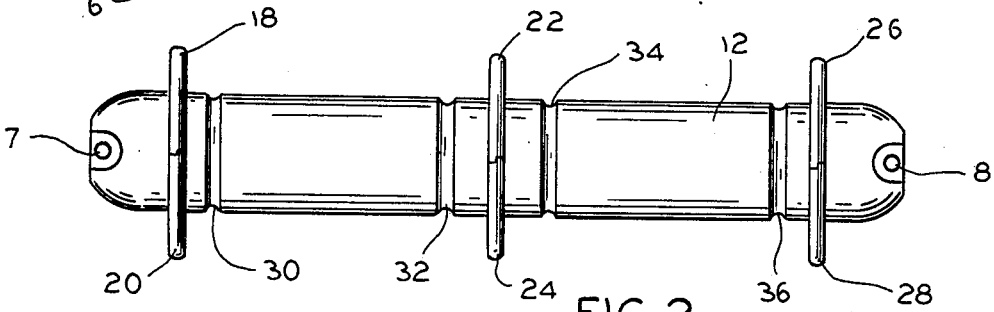
FIG. 2 is a top plan view of the invention.
Figure 3:
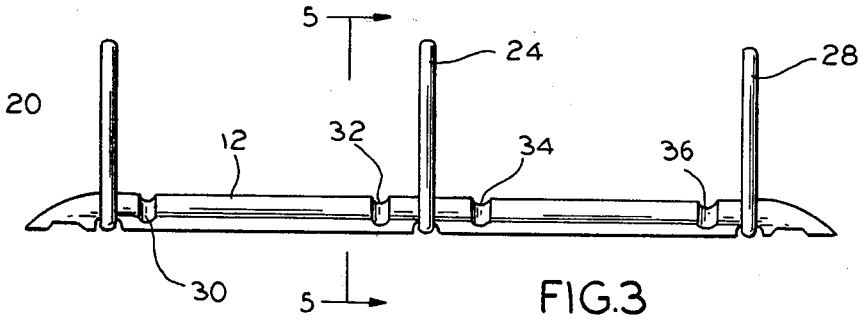
FIG. 3 is a side elevation view of the invention.
Figure 4:
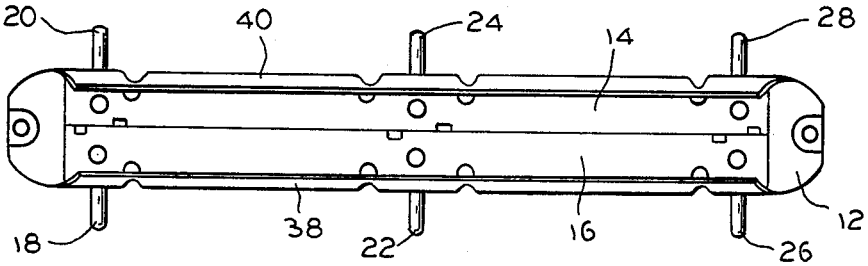
FIG. 4 is a bottom plan view of the invention.

As shown in FIGS. 1–4, ring mechanism 10 constructed in accordance with the teachings of this invention comprises a curved base plate 12, a pair of blades 14 and 16, and three pairs of ring elements or posts 18 and 20, 22 and 24, and 26 and 28. While three pairs of ring elements are shown in the drawings, the number of pairs is not essential to the invention, provided that at least one pair is present. The ring mechanism is usually used within a cover 5 as shown.

Base plate 12 is constructed of a slightly resilient, strong material, such as sheet metal. The base plate 12 is affixed to the back 6 of cover 5 as by rivets 7 and 8. The inventive base plate also includes at least one protruding portion or rib 30 extending laterally across the width of the base plate 12. These ribs are preferably integrally formed from the base plate. It is desirable, but not essential, that the number of ribs be at least equal to the number of pairs of ring members. Thus, additional ribs 32, 34 and 36 are shown with the three pairs of ring members. The ribs should also be positioned along the base plate near each of the ring member pairs because, as discussed subsequently, the ribs also help prevent longitudinal displacement of the blades and, consequently, lateral displacement of the ring members. Preferably, the ribs have a semi-circular cross section which may range from one-eighth inch to one-quarter inch in diameter.

Figure 5:
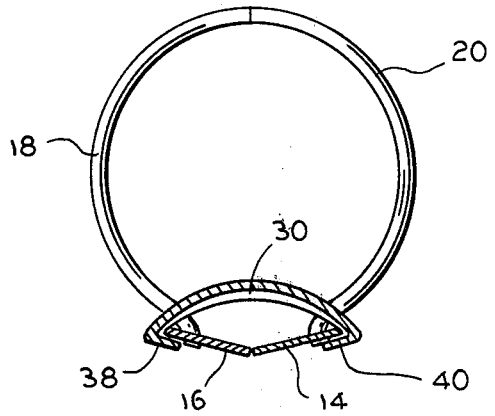
FIG. 5 is a cross-sectional view taken along line 5—5 of FIG. 3.
Figure 6:
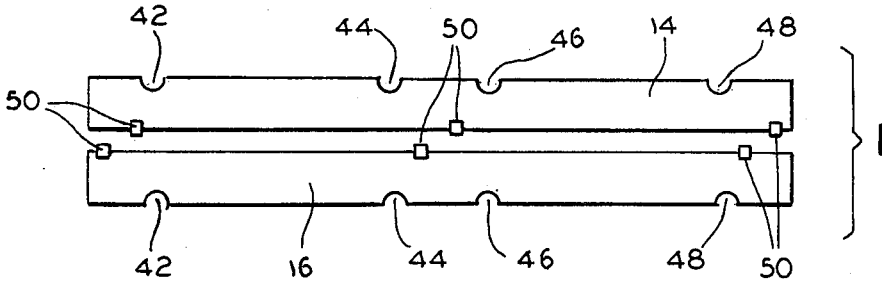
FIG. 6 is a plan view of the blades forming a part of the invention.

As best shown in FIG. 5, the base plate 12 also has flanges or lips 38 and 40 along its longitudinal edges. The lips 38 and 40 curl under the base plate 12 and help retain the pair of blades 14 and 16 beneath the base plate. The blades 14 and 16, which are shown in FIG. 6, are rigid strips of metal extending substantially the length of the base plate. The combined width of the blades is slightly greater than the distance between the lips 38 and 40. This results in the blades being oriented in a somewhat buckled position, either conversely or convexly, beneath the base plate. The blades have a plurality of teeth 50 along their inside edges which interlock the blades to each other.

The blades 14 and 16 also each have at least one slot 42 along their outside edges where they meet the base plate 12. The slots 42 correspond in size and shape with the cross-section of the ribs and the slots 42 are located so that they will receive or engage the rib when they are properly positioned beneath the base plate 12. When additional ribs 32, 34, and 36 are used, a corresponding number of slots 44, 46, and 48 are also provided in appropriate locations in blades 14 and 16.

The pairs of ring elements or posts 18, 20, 22, 24, 26, and 28 extend up from blades 14 and 16 above base plate 12. Each post is fixed at one end to one of the blades by means well known in the art. The posts have a diameter suitable for insertion through the apertures in commonly used notebook paper and may be of various lengths. The posts are shaped so that the free end of each post will meet with the free end of the corresponding member of the pair at a juncture above the base plate. The posts are preferably metal and may be bent in a variety of configurations, provided that the posts meet at their free ends.

Figure 7:
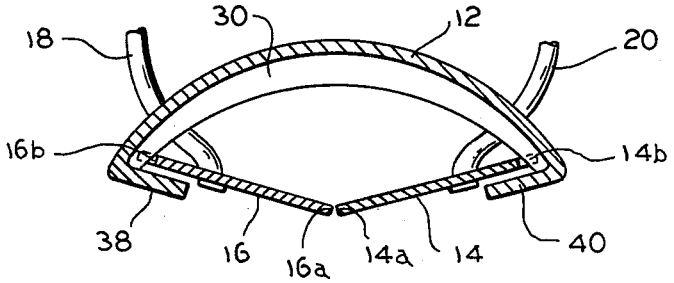
FIG. 7 is a partial cross-sectional view of the invention showing the blades in a convex position.
Figure 8:
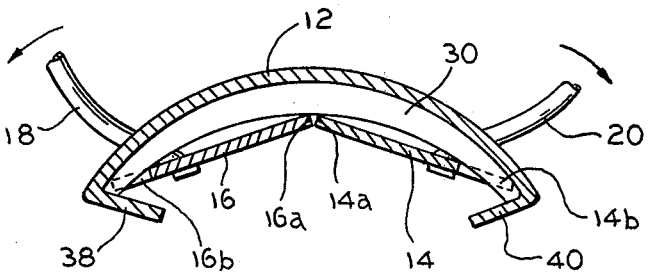
FIG. 8 is a partial cross-sectional view of the invention showing the blades in a concave position.

When the posts are to be separated, such as when paper is to be added or removed, they are simply pulled apart by the user. This causes the inside longitudinal edges 14*a* and 16*a* of the blades to move upward toward the ribs and the underside of the base plate, while the outside longitudinal edges 14*b* and 16*b* of the blades remain within the lip and in engagement with the ribs as seen in FIG. 8. In this position, the blades are locked in a concave position when viewed in cross-section, and the posts are similarly locked in an open position. To close the posts, they are urged together by the user, forcing the inside longitudinal edges 14*a* and 16*a* of the blades downward until they lock in a generally convex position, as shown in FIG. 7. As before, the outside edges 14*b* and 16*b* of the blades remain within the lips and in engagement with the ribs.

The force exerted on the posts and blades to operate the ring mechanism may be substantial, depending primarily on the resiliency of the base plate. This normal operating force, and/or the wear and tear on the binder from everyday use, often causes slippage in a longitudinal direction of the blades relative to each other. This in turn causes the posts to fail to meet above the base plate, and paper can be lost from the binder. If this displacement is substantial, the entire ring mechanism can disassemble. The engagement of the ribs with the slots prevents this longitudinal displacement and disassembly, and helps maintain the blades in their proper location beneath the base plate. In addition, the ribs reinforce the base plate and increase tension applied to the blades, which further insures a more secure and reliable connection of the ring members.

While the principles of the invention have been described above in connection with specific apparatus and applications, it is to be understood that this description is made only by way of example and not as a limitation on the scope of the invention.

I claim:

1. An apparatus for storing paper having apertures near the edge of the paper, comprising: a resilient base plate, said base plate having a curled lip along each of its longitudinal edges; a pair of blades extending side by side under said base plate between said curled lips, the combined width of said blades being slightly greater than the distance between said curled lips, said blades also each having at least one slot along its periphery with said lip; at least one rib extending laterally across the underside of said base plate and engaging said blades at said slots; and at least one pair of ring members for insertion through said paper apertures and for retaining said paper, each of said ring members fixed to a different one of said blades and meeting in a releasable juncture above said base plate, whereby the engagement of said blades and rib resists mutual longitudinal displacement of the blades.

2. The apparatus of claim 1 wherein said rib is integrally formed from said base plate.

3. The apparatus of claim 1 wherein there is at least one rib next to each pair of ring members.

4. A ring mechanism for use in binders for loose-leaf paper having apertures, comprising: a resilient metal shield, said shield having downwardly curled longitudinal edges; a pair of blades beneath said shield extending substantially the length of said shield and nested between said curled edges, said blades being slightly greater in combined width than the distance between said curled edges, said blades also having a plurality of slots along their outside periphery; a plurality of depressions each extending laterally across the underside of said shield and engaging said blades at said slots; and at least one pair of posts for insertion through the apertures of the paper, each of said posts being fixed at one end to a different blade, said posts extending above said shield to receive said paper and to meet in a releasable juncture, whereby the engagement of said slots and depressions resists longitudinal displacement of said blades and insures a proper juncture of said posts.

5. In combination with a loose leaf binder wherein a ring assembly is fixed within a cover, and wherein the ring assembly includes a resilient base plate, a pair of blades nested underneath the base plate and between the curled edges of the base plate, the blades having a combined width slightly greater than the distance between the curled edges, and at least one pair of posts fixed to the blades and meeting in a releasable juncture above the base plate, the improvement which comprises: at least one rib integrally formed with said base plate and adjacent to each pair of posts, said rib extending laterally across and downwardly from said base plate to engage slots formed along the outside longitudinal edges of said blades, whereby the engagement prevents longitudinal displacement of said blades and insures a proper connection of said posts.

* * * * *